United States Patent [19]

Byrd, Jr.

[11] 3,952,470

[45] Apr. 27, 1976

[54] FURNACE LINING APPARATUS

[75] Inventor: Carlisle O. Byrd, Jr., Houston, Tex.

[73] Assignee: J T Thorpe Company, Houston, Tex.

[22] Filed: June 3, 1974

[21] Appl. No.: 475,439

[52] U.S. Cl. ..... 52/509; 52/424; 52/511; 52/513; 52/622; 110/99 R

[51] Int. Cl.[2] ..... E04B 1/80

[58] Field of Search ..... 52/506, 511, 513, 404, 52/622, 743; 110/99 A

[56] References Cited

UNITED STATES PATENTS

| | | | |
|---|---|---|---|
| 2,120,133 | 6/1938 | Kohler | 52/506 X |
| 2,144,598 | 1/1939 | Brinckerhoff et al. | 110/1 A |
| 2,409,951 | 10/1946 | Nootens | 52/404 |
| 3,159,235 | 12/1964 | Young et al. | 52/404 |
| 3,362,698 | 1/1968 | Cerny et al. | 52/246 X |
| 3,523,395 | 8/1970 | Rulter et al. | 52/506 X |
| 3,605,370 | 9/1971 | Prible | 52/513 |
| 3,687,093 | 8/1972 | Byrd, Jr. | 52/506 X |
| 3,832,815 | 9/1974 | Balaz et al. | 52/506 X |

FOREIGN PATENTS OR APPLICATIONS

| | | | |
|---|---|---|---|
| 455,040 | 10/1936 | United Kingdom | 110/99 R |

*Primary Examiner*—Alfred C. Perham
*Attorney, Agent, or Firm*—Pravel & Wilson

[57] ABSTRACT

A new and improved apparatus and method for lining walls of furnaces, and other high temperature equipment, wherein insulating blankets are folded and supports are mounted in the folds thereof for mounting to the furnace wall to insulate the furnace. In some applications, the lining apparatus is formed into preformed insulation blocks for installation as insulating linings.

8 Claims, 8 Drawing Figures

A
B
B
B
B
K
R
R
P
P
S
10
10a
10b
12
12a
12b
14
18
20b
20c
22
28
30
32
34
34a
36
36a
38
38a
40
40a
40b
44
48
52
54
56
58
60
62
64

FURNACE LINING APPARATUS

BACKGROUND OF THE INVENTION

1. Field of the Invention:

The present invention relates to apparatus and methods for attaching and installing linings in furnaces or other high temperature equipment.

2. Description of the Prior Art:

It has been known to use refractory bricks or structure to line furnaces, as exemplified in U.S. Pat. Nos. 741,629; 1,701,480; 1,813,790; 2,368,265; 3,302,356; 3,362,698 and 3,630,503.

Ceramic fibers or blankets made from refractory fibrous materials such as chromia-alumina-silica, alumina-silica compositions and zirconia compositions have become desirable as furnace insulation because of their ability to withstand high temperatures. In the past, efforts have been made to attach the fiber or blanket material to the furnace wall using stainless steel attachment structure, but this attachment structure has often been unable to withstand the high temperatures present at the insulation surface and melted or otherwise failed. Further, the ceramic fibers tended to vitrify and shrink during long exposure to high temperatures.

Also, other prior art efforts, such as in U.S. Pat. Nos. 2,341,777; 3,147,832; 3,523,395; 3,687,093; 3,738,217; 3,742,670 and 3,771,467, were made to impale or spear the ceramic blanket on a pin or stud mounted with the furnace wall, with a washer mounted at the end of the stud to hold the blanket in place. However, the blanket tended to sag and tear away from the furnace wall with this structure. Also, the studs served as conduits for heat through the blanket to the furnace wall.

SUMMARY OF THE INVENTION

Briefly, the present invention provides a new and improved apparatus and method for lining a wall or roof of a furnace and like high temperature equipment wherein a folded insulating blanket of refractory fibrous material is provided with a support mounted lengthwise and embedded within a fold in the blanket to support the blanket, and a mounting means serves to mount the support to the furnace wall to provide a lateral extended area of support for the insulating material to avoid tearing of the fiber. With the support extending lengthwise of the fold in the fiber, the attachment to the furnace wall is subjected to lower temperatures than those present at the hot face or insulation surface.

The apparatus of the present invention can be readily formed into preformed insulation blocks for installing the linings in furnaces or other high temperature equipment.

It is an object of the present invention to provide a new and improved apparatus and method for lining a wall of a furnace or other high temperature equipment.

DESCRIPTION OF THE PREFERRED EMBODIMENT

Figure 1:
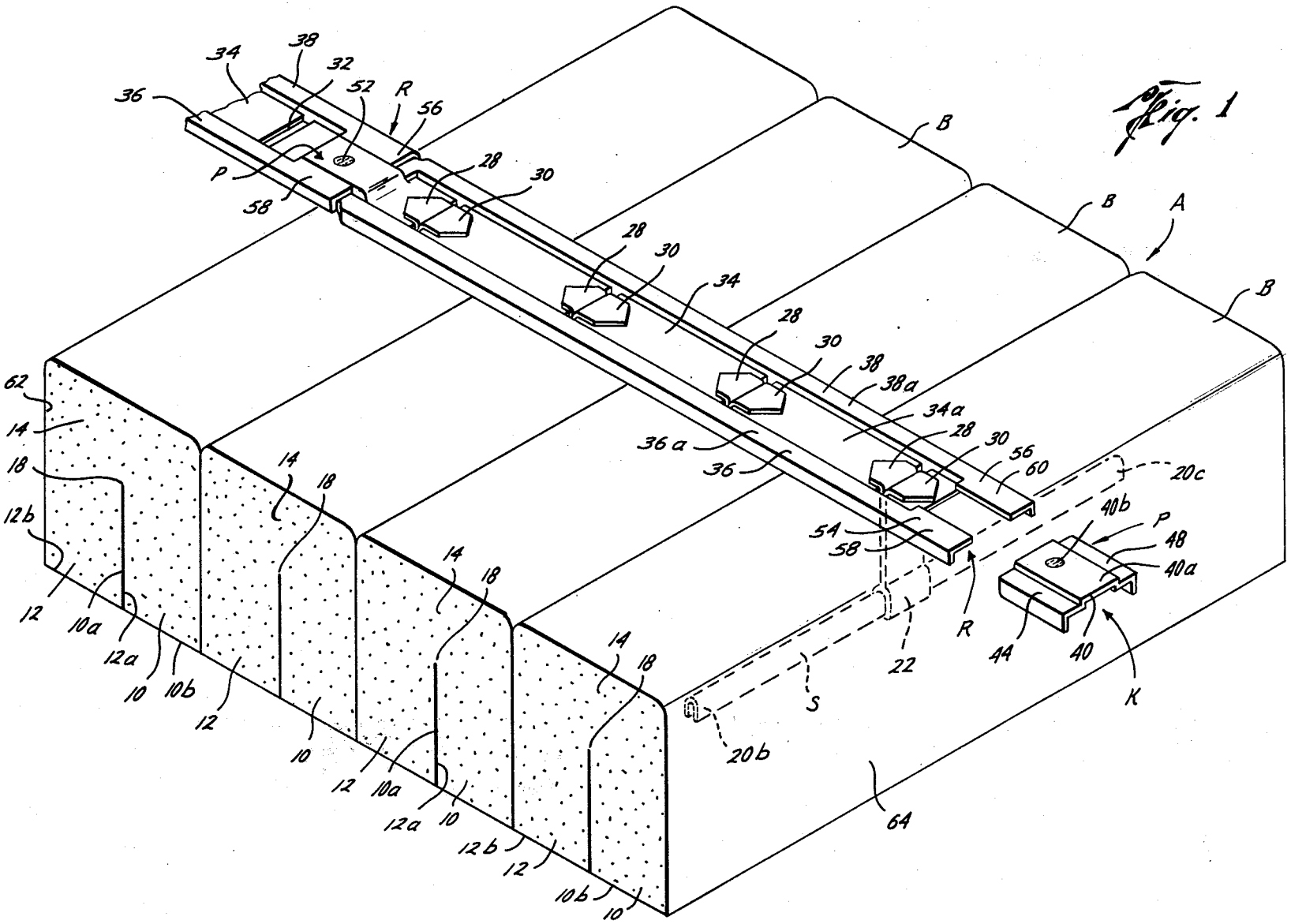
FIG. 1 is an isometric view, partly in phantom, of the apparatus of the present invention.

In the drawings, the letter A designates generally the apparatus of the present invention for lining a wall W (FIG. 3), which may be either a side wall or a roof, of a furnace or of some other high temperature equipment such as soaking pits, annealing furnaces, stress relieving units and the like.

The apparatus A is in the form of a preformed insulating block I having a plurality of folded blankets B for insulating the furnace, a support S mounted in a fold in each of the folded blankets B and an attachment mounting M for mounting the supports S and the blankets B to the wall W.

Considering the blankets B more in detail, each such blanket is formed from a suitable commercially available ceramic fiber sheet, such as the type known as "cerafelt" sold by the Johns-Manville Company, containing alumina-silica fibers or other suitable commercially available refractory fibrous materials. It should be understood that the particular component materials of the ceramic fiber sheet used in the blankets B are selected based upon the range of temperatures in the high temperature equipment in which the apparatus A is to be installed.

The blanket B is formed by folding a first end portion 10 and a second end portion 12 of the fiber sheet inwardly towards each other to contact along inner surfaces 10a and 12a, respectively, so that the blanket is in the general form of an inverted U, with a center portion 14 connecting the folded end portions 10 and 12 at an end opposite surfaces **10*b* and 12*b* which are exposed to the high temperature conditions at the insulation surface, or hot face as termed in the art, with a fold 18 formed at the common juncture of the surfaces 10*a* and 12*a* of the folded end portions 10 and 12 with the center portion 14**, and extending the width of the blanket B.

The blanket B is supported by a support beam 20 of the support S mounted in the fold 18 of the blanket B. The support beam 20 is formed from a folded bar of a high temperature-resistant metal or alloy, although other shapes of support beams and other materials may be used, as will be set forth below. The support beam 20 is mounted at a center portion **20*a* (FIG. 4) thereof within a loop 22 formed at a lower end juncture of suspension arms 24 and 26 of a suspending or support tab T of the attachment mounting M. The support beam 20 may be welded, such as by spot welding, in the loop 22 and the suspension arms 24 and 26** welded together for additional strength and support, if desired.

An opening is formed adjacent the surface 14a in the center portion 14 of the blanket B extending upwardly from the fold 18 therein for passage of the suspension arms 24 and 26 therethrough. It is to be noted, for reasons to be set forth, that the support beam 20 is mounted to extend outwardly to ends 20b and **20*c***

(FIG. 1) from the center portion 20*a* thereof over a substantial portion of the lateral extent of the fold 18 in the blanket B in comparison to the width of the loop 22.

Figure 2:
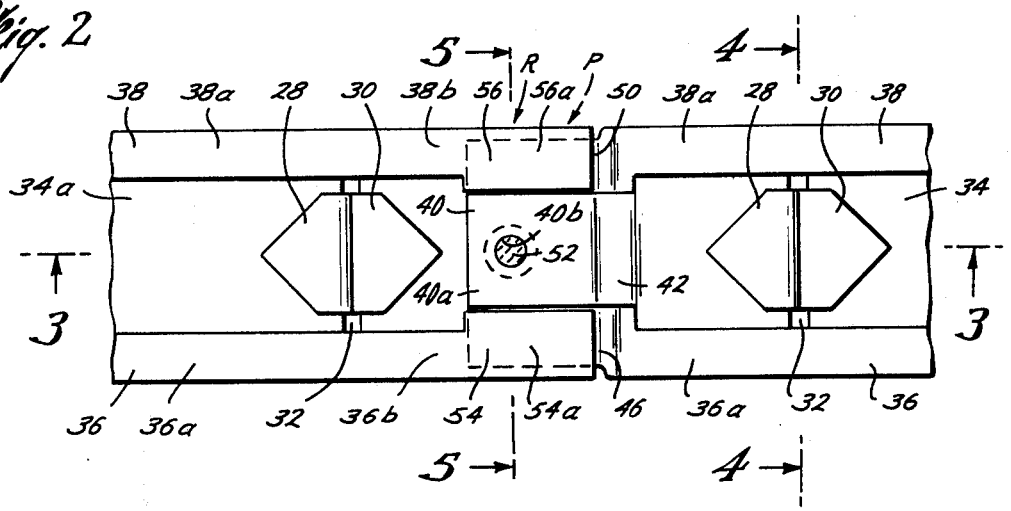
FIG. 2 is a plan view of a portion of the apparatus of the present invention.
Figure 4:
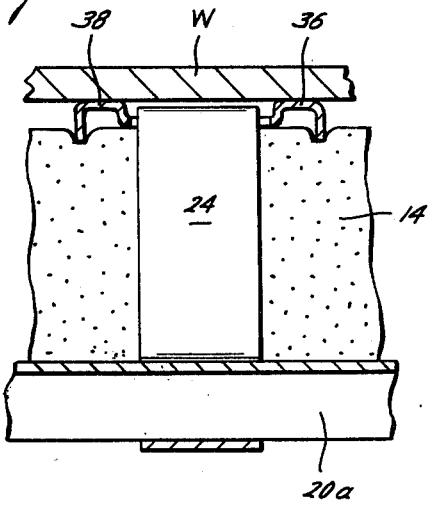
FIG. 4 is a cross-sectional view taken along the lines 4—4 of FIG. 2.

Mounting lugs 28 and 30, formed at upper ends of the suspension arms 24 and 26, respectively, of each of the support tabs T extend through mounting orifices 32 in a central attachment beam or stringer channel member 34 of the attachment mounting M. The central attachment beam 34 of the attachment mounting M is mounted between outer mounting rails 36 and 38 of the attachment mounting M. The mounting rails 36 and 38 are elevated with respect to the attachment beam 34 (FIG. 4) so that the mounting lugs 28 and 30 after insertion through the mounting orifice 32 may be depressed against an upper surface 34a (FIG. 2) of the attachment beam 34 and thus not extend above an upper surface 36a and 38a of the outer mounting rails 36 and 38 which form a flush attachment surface for mounting the apparatus A to the wall W (FIG. 4). If desired, the mounting lugs 28 and 30 may be suitably welded to the surface 34a.

The apparatus A is in the form of a preformed insulating block, as has been set forth, in a typical example 12 inches in lateral width and 12 inches in length, with the thickness of the insulation depending upon the amount of insulation required. The preformed insulating blocks are adapted to be assembled and installed, in a manner to be set forth, over the inner surface area of the side walls and roof, or other surface, of high temperature equipment of the type set forth above.

Accordingly, each of the attachment mountings M has an attachment receptacle R formed at an end thereof and an attachment pin member P formed at an end opposite the attachment receptacle R. The attachment receptacle R of the apparatus A receives the attachment pin P of an adjacent block of the apparatus A, while the attachment pin P of the apparatus A extends outwardly (FIG. 1) beyond the preformed insulation block to provide access for welding in order to mount the apparatus A to the wall W. After such mounting, the pin P is fitted into an attachment receptacle R of another adjacent block of the apparatus A (FIG. 1), as will be set forth. A starting anchor K (FIG. 1) having an attachment pin P mounted therewith, formed by cutting an end of the attachment mounting M or by other suitable methods may be used to serve as a starting attachment point for installation of the blocks of the apparatus A to the wall W.

Considering the attachment pin P more in detail, a raised tongue member 40 extends outwardly from a ramp 42 at the attachment beam 34 adjacent the attachment pin P. The tongue member 40 has an upper surface 40*a* substantially coplanar with the upper surfaces 36*a* and 38*a* of the mounting rails 36 and 38 for ease in mounting the apparatus A with the wall W. A mounting shoulder 44 is formed extending downwardly from a ramp 46 at an end of the mounting rail 36 adjacent the attachment pin P, while a mounting shoulder 48 is formed extending downwardly from a ramp 50 at an end of the mounting rail 38 adjacent the attachment pin P.

Figure 5:
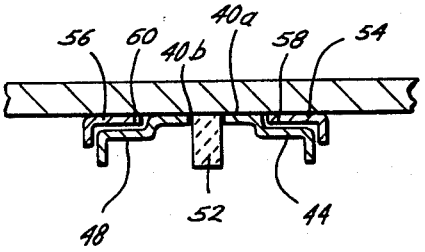
FIG. 5 is a cross-sectional view taken along the lines 5—5 of FIG. 2.
Figure 6:
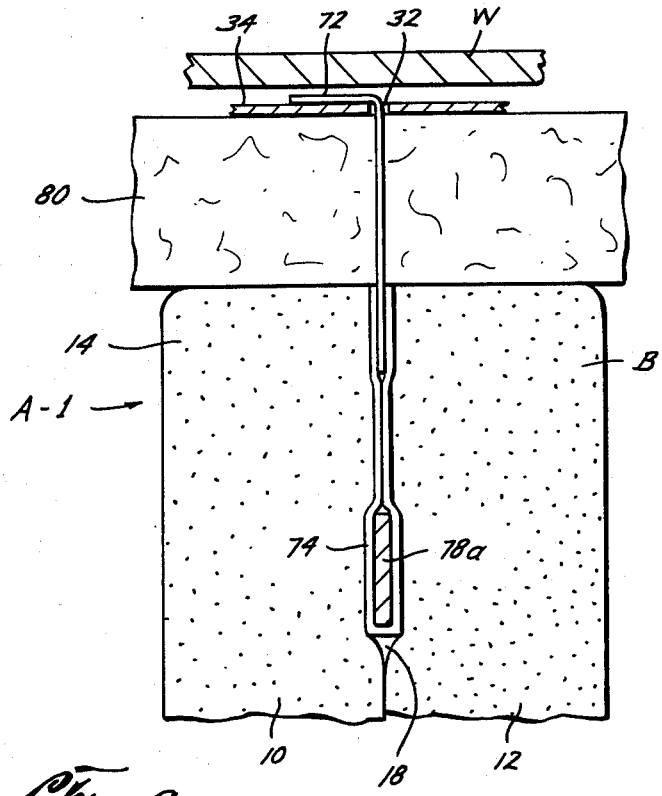
FIG. 6 is a cross-sectional view of an alternative apparatus of the present invention.
Figure 7:
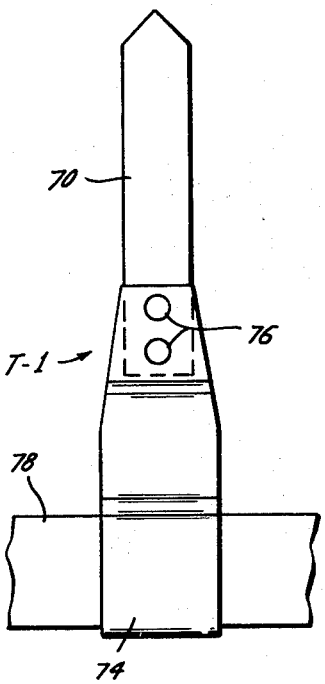
FIG. 7 is an elevation view of a portion of the apparatus of FIG. 6 with portions thereof broken away.

An opening 40*b* is formed in the tongue 40 so that a welding stud 52 (FIGS. 2, 3 and 5), such as the type sold by the Nelson Stud Welding Company, may be inserted into such opening (FIG. 5) and spot welded to both the tongue 40 and the wall W (FIG. 3) in order to mount the attachment mounting M to the wall W. It should be understood that other welding techniques or suitable connecting structure such as screws, bolts and the like may be used to mount the attachment mounting M to the wall W, if desired.

The attachment receptacle R includes receiving channels 54 and 56 formed at an end of the attachment mounting M opposite the attachment pin P. Upper surfaces 54*a* and 56*a* of the receiving channels 54 and 56 are substantially coplanar with the upper surfaces 36*a* and 38*a* of the mounting rails 36 and 38 for ease in mounting the apparatus A flush with the wall W. The channels 54 and 56 of the attachment receptacle R receive the shoulders 44 and 46 (FIG. 5) of the attachment pin P of the adjacent block of the apparatus A and support the attachment mounting M in the apparatus A on the wall W. Lip members 58 and 60 (FIGS. 1 and 5) are formed extending inwardly from the channels 54 and 56, respectively, to define a slot to receive the tongue 40 of the attachment pin P of the adjacent block of the apparatus A. The lip members 58 and 60 assist in supporting the attachment mounting M with the wall W, since such lip members are supported by the shoulders 44 and 46 of the next adjacent insulating block.

In carrying out the method of this invention using the apparatus A as an insulating lining for the wall W, preformed insulating blocks of the apparatus A are initially formed. Openings for the suspension tabs T are preferably first formed in the ceramic fiber sheets to be formed into the blankets B, support beams 20 are mounted with the suspension tabs T, and the suspension tabs T are then inserted into the openings in the blankets B. Alternatively, instead of initially forming openings in the ceramic fiber sheets, the pointed tabs 28, 30 puncture the sheets and form their own openings therethrough. The blankets B are then folded into the inverted U configuration, forming the fold 18 with the support beam 20 mounted therein.

Figure 3:
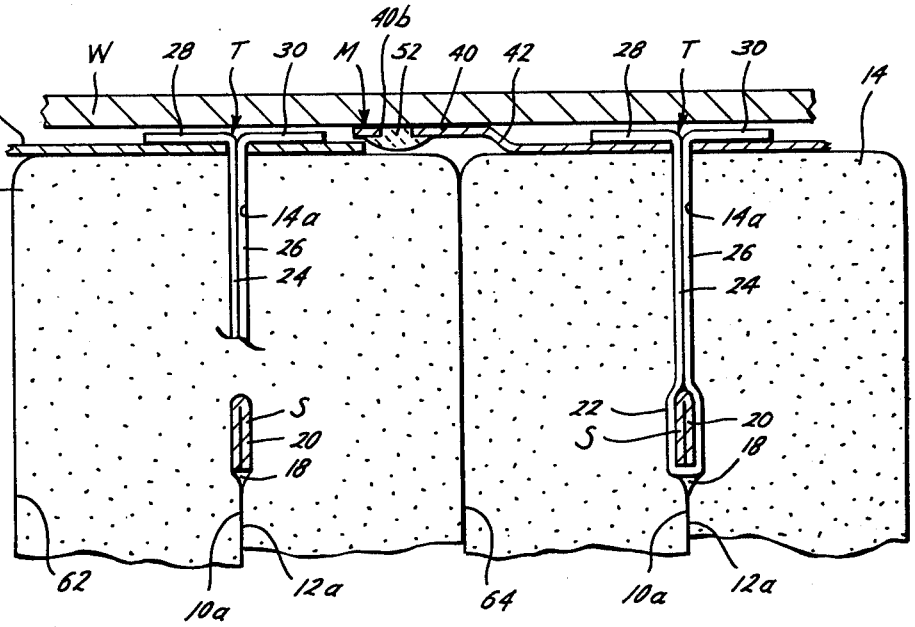
FIG. 3 is a cross-sectional view, with a portion thereof broken away to show other structural details, taken along the lines 3—3 of FIG. 2.

Forming the blankets B in the folded configuration in the manner set forth with the present invention has been found to afford an additional advantage. After folding, the blankets B are engaged along outer surfaces 62 and 64 and compressed inwardly, using suitable pressure exerting means, about (25%) of their uncompressed width. By compressing the folded blankets B in this manner, it has been found that compensation can be obtained for the shrinkage and vitrification of the ceramic fibers in the blankets B due to long exposure to high temperatures. Further, compressing the blankets B additionally serves to embed the beam 20 firmly within the fold 18 at portions of the beam 20 away from the center portion 20a, as shown in FIG. 3, where a portion of the leftmost suspension tab T is broken away to show such firm embedding of the beam 20 within the fold 18.

After the blankets B are compressed, the suspension tabs T are inserted into the orifices 32 in the channel member M and the mounting lugs 28 and 30 of the tabs T are bent downwardly against the upper surface 34a of the attachment beam 34.

After formation into prefabricated insulation blocks in the mannern set forth above, the blocks of the apparatus A are then ready to be attached to the inner surface area of the wall in high temperature equipment.

A suitable starting point for installation to begin, such as at a position adjacent an intersection of the wall W with two other walls in the equipment, is chosen. The starting point is located, in a typical example, so that a starting anchor K extends along the wall W in an installation line parallel to the intersection with one of the other walls and outwardly from an intersection with the other of the walls, and spaced so that an insulating block may be mounted with the anchor K and contact one of the two other walls along side surfaces of the blankets B mounted with such insulating block.

The starting anchor k is spot welded to the wall W at the starting point, and a block of the apparatus A mounted with its attachment mounting M extending along the installation line by inserting the attachment pin P of the starting anchor K into the attachment receptacle R of the insulating block A. In order to insulate the space beneath the starting anchor K adjacent the wall W, a block or roll of insulating material of suitable thickness is inserted beneath the starting anchor K and held in place therebeneath between the block A and the adjacent wall surface. The attachment pin P of the insulating block A is then spot welded, attaching the channel member M of the insulated block A to the wall W. A second block A is then mounted in alignment with the first mounted insulated block by inserting the attachment receptacle R of the second block over the attachment pin P of the mounted block, with the attachment mountings M of the two blocks extending in alignment along the installation line across the wall W. The attachment pin P of the second block is then spot welded to the wall W in the manner set forth above.

Installation of the prefabricated insulation blocks A in alignment along the installation line continues in the manner set forth across the wall W over a first length of the surface area of the wall W, covering at least a portion thereof, until a stopping point at an opposite edge of the wall W from the starting point is reached. A block or roll of insulation is inserted between the last insulating block and the opposite wall beneath the stopping point.

A second installation line is then begun by mounting a second starting anchor K at a second starting point spaced from the first starting point so that the side surfaces of the blankets B along adjacent installation lines contact each other, preferably exerting a slight compressive force on each other. Successive insulating blocks are then installed in alignment in sequence, one after the other, by inserting the attachment receptacle R of the next successive block over the attachment pin P of the previously installed block.

Installation of successive preformed insulating blocks B, in the manner set forth, continues in a sequence of aligned installation lines across successive lengths of the surface area of the wall W until an insulating lining has been installed over the surface area of the wall W to be insulated. Where necessary, various lengths of attachment mountings M and widths of blankets B may be preformed into insulating blocks A in order to permit ease of installation over various surface areas.

With the support beam 20 mounted extending outwardly from the center portion 20a thereof over a substantial portion of the lateral extent of the fold 18 in the blanket B in comparison to the width of the loop 22 of the support tab T, an increased lateral surface area of support is provided for the blanket B in contrast to the prior art impaling or mounting studs. Further, the surface area support of the blanket B by the support beam 20 assists in counteracting any sagging of the ceramic fiber blanket after long exposure to high temperatures.

Further, it should be noted that mounting the support beam 20 extending lengthwise in the fold 18 places the support beam 20 and the suspension tab T at a position spaced within the blanket B from the surface **10*b* and 12*b* of the end portions 10 and 12 of the blanket B which are exposed to the high temperature conditions in the equipment being insulated, assisting in preventing heat transfer to the exterior of the wall W by means of the support beam 20** and suspension tab T.

In addition to the preferred embodiment set forth above, the apparatus of the invention may take the form of several alternative embodiments. In such alternative embodiment, like structure performing like functions bears like reference numerals.

In an alternative apparatus A-1, a suspension tab T-1 includes a high temperature steel suspending arm 70 having a mounting lug 72 formed at an upper end thereof for insertion through the orifice 32 in the attachment beam 34. A suspending loop member 74 formed from a suitable refractory material, such as the type known as "ceraform", is mounted with lugs 76 at a lower end of the arm 70. A support beam 78, formed from a suitable refractory material, is mounted at a center portion **78*a* thereof with the suspending loop 74 within the fold 18** of the blanket B.

In the apparatus A-1, a slab or block 80 of conventional mineral wool is mounted between the blanket B and the channel member M for further insulation. It should be understood that a slab or block of mineral wool may also be used with the apparatus A, if desired.

Figure 8:
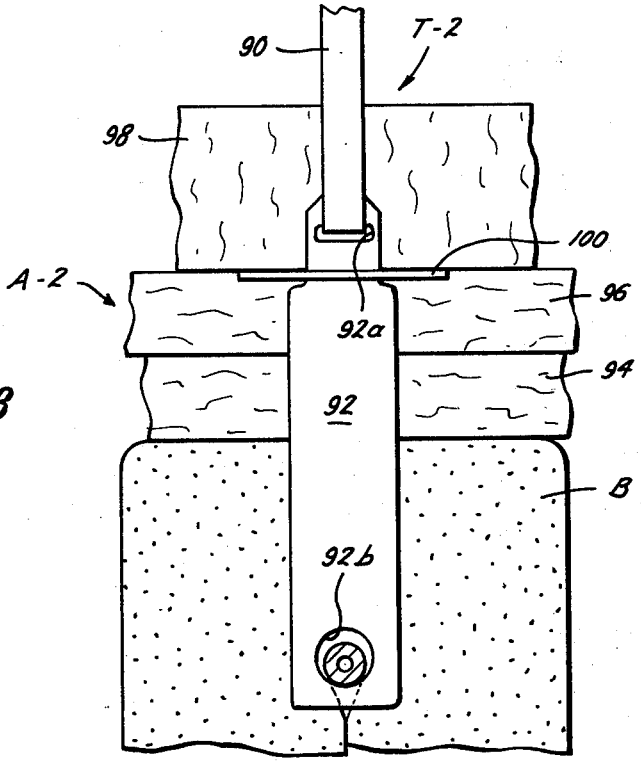
FIG. 8 is a cross-sectional view of another alternative apparatus of the present invention.

In an alternative apparatus A-2 (FIG. 8), a suspending tab T-2 includes a high temperature steel strap 90 to mount the blanket B with the wall W. The strap 90 extends upwardly through an orifice formed in the attachment mounting M. The support tab T-2 is formed from thin, flat structural members which extend into the blanket B in a vertical plane transverse to the plane of the suspension tab T-1, and thus with the support tab T-2, orifices are formed in the attachment mounting M transverse the orifices 32 for insertion of the steel strap 90, and the upper ends of the steel strap 90 are bent to fit within the channel between the side rails 36 and 38.

A support tab 92 is mounted with the steel strap 90 at a slot formed adjacent the surface 92a in its upper end. A lower opening adjacent a surface **92*b* receives a support beam 92 which is formed from a length of refractory ceramic tubing, such as "mullite", and is mounted within the fold 18** in the blanket B.

In the apparatus A-2, plural layers or slabs 94, 96 and 98 of mineral wool or other suitable material are mounted between the blanket B and the wall W. A washer 100 is mounted about the tab 92 between the layers 96 and 98 to support the slab 98 of mineral wool. Similar washers (not shown) may be used to support the layers 94 and 96, if desired.

It should be further understood that although each of the embodiments of the apparatus set forth above are in the form of a plurality of folded insulated blankets to form a prefabricated insulated block, each of the prefabricated insulated blocks could be a single block or any desirable number of blocks mounted, with a support beam therein, to an attachment mounting M and attached thereby to the wall W where a space limitation within the furnace limits the area of the wall W, or for other reasons.

Further, for additional support or where otherwise desirable, the beam 18 may be supported by two or more support tabs T at suitable positions spaced across the lateral extent of the blankets B, and each group of support tabs T at a common spaced position in adjacent blankets B mounted with a common attachment mounting M, so that each block of blankets is supported from plural spaced attachment mountings M supporting the beams therein.

Although the present invention is described in the preferred embodiment as insulating high temperature equipment, it should be understood that the apparatus of the present invention may be used to insulate low temperature or cryogenic equipment, as well.

The foregoing disclosure and description of the invention are illustrative and explanatory thereof, and various changes in the size, shape, and material as well as in the details of the illustrated construction may be made without departing from the spirit of the invention.

I claim:

1. An apparatus for lining a wall of a furnace and like equipment, comprising:

a. a folded ceramic fiber blanket having a fold formed in a central portion thereof and having two end portions thereof folded together and extending from said fold for insulating the furnace;

b. a support beam mounted extending along the length of said fold in said folded blanket, said folded end portions of said folded blanket also extending inwardly from said support beam to assist in insulating said support beam;

c. a suspension arm having said support beam mounted therewith at a position on said support beam within said fold in said folded blanket;

d. said suspension arm extending from an inner end portion in said fold through said central portion of said folded blanket to an outer end portion;

e. an attachment beam for mounting with the wall of the furnace, said attachment beam having a mounting orifice formed therein;

f. said suspension arm further having a mounting lug, formed at said outer end portion thereof, inserted into said mounting orifice in said attachment beam for attaching said folded blanket and said suspension arm to said attachment beam; and g. said attachment beam further having connecting openings formed therein for passage of connecting members therethrough to attach said attachment beam to the wall of the furnace wherein said folded blanket forms an insulating lining for the wall of the furnace.

2. The apparatus of claim 1, wherein a plurality of mounting orifices are formed in said attachment beam and further including:

a. a plurality of folded ceramic fiber blankets, each having a fold formed in a central portion thereof and having two folded end portions thereof folded together and extending from said fold for insulating the furnace;

b. a plurality of support beams, each mounted extending along the length of said fold in one of said folded blankets, said folded end portions of each of said folded blankets also extending inwardly from one of said support beams to assist in insulating said support beams;

c. a plurality of suspension arms, each having one of said support beams mounted therewith within a fold of one of said folded blankets, and extending therethrough; and d. each of said plurality of suspension arms having a mounting lug therewith inserted into one of said plurality of mounting orifices in said attachment beam.

3. The apparatus of claim 1, wherein said support beam comprises:

a support beam mounted extending within said fold along a substantial portion of the length thereof to provide increased support for said folded blanket.

4. The structure of claim 1, wherein said support beam comprises:

a ceramic support beam.

5. The structure of claim 1, wherein said support beam comprises:

a high temperature-resistant metal beam.

6. The structure of claim 1, further including:

an insulating pad mounted between said folded blanket and said attachment beam and having an opening therein for passage of said suspension arm therethrough.

7. The apparatus of claim 1, wherein plural apparatus are mounted with the furnace wall to line the furnace wall and wherein said attachment beam of each of said plural apparatus further includes:

an attachment pin and an attachment receptacle formed at opposite ends of said attachment beam for connecting said attachment beam to adjacent attachment beams.

8. An apparatus for lining a wall of a furnace and like equipment, comprising:

a. a folded ceramic fiber blanket having a fold formed in a central portion thereof and having two end portions thereof folded together, said folded end portions extending from said fold for insulating the furnace and being held in compression to reduce vitrification and shrinkage of said blanket;

b. a support beam mounted extending along the length of said fold in said folded blanket;

c. a suspension arm having said support beam mounted therewith at a position on said support beam within said fold in said folded blanket;

d. said suspension arm extending from an inner end portion in said fold through said central portion of said folded blanket to an outer end portion;

e. an attachment beam for mounting with the wall of the furnace, said attachment beam having a mounting orifice formed therein;

f. said suspension arm further having a mounting lug, formed at said outer end portion thereof, inserted into said mounting orifice in said attachment beam for attaching said folded blanket and said suspension arm to said attachment beam; and g. said attachment beam further having connecting openings formed therein for passage of connecting members therethrough to attach said attachment beam to the wall of the furnace wherein said folded blanket forms an insulating lining for the wall of the furnace.

* * * * *